United States Patent [19]

Miller

[11] Patent Number: 4,908,743

[45] Date of Patent: Mar. 13, 1990

[54] STRIP LIGHTING ASSEMBLY

[76] Inventor: Jack V. Miller, 700 N. Auburn Ave., Sierra Madre, Calif. 91024

[21] Appl. No.: 366,637

[22] Filed: Jun. 15, 1989

[51] Int. Cl.[4] ..... F21V 1/00

[52] U.S. Cl. ..... 362/238; 362/240; 362/249; 362/300; 439/110

[58] Field of Search ..... 362/235, 238, 240, 244, 362/245, 249, 252, 800; 439/110

[56] References Cited

U.S. PATENT DOCUMENTS

| | | | |
|---|---|---|---|
| 3,214,579 | 10/1965 | Pacini | 439/110 |
| 4,521,835 | 6/1985 | Meggs et al. | 362/800 |
| 4,654,765 | 3/1987 | Laidman | 362/238 |

*Primary Examiner*—Carroll B. Dority

[57] ABSTRACT

A low voltage strip lighting assembly has an elongated flexible insulator strip having a base including two sides and a top surface having elongated slits that retain flat electrical conductors. A miniature wire terminal lamp bulbs are adjacent to the top surface of the insulator strip with terminals extending from the top surface of the insulator strip into a slit in the insulator strip to electrically contact one side surface of a respective flat conductor at any point along the length of the insulator strip, whereby the application of electrical power from an external source to each of the respective conductors will light the bulbs. A generally U-shaped lens covers the light bulbs and has legs engaging the sides of the insulator and inwardly-biased and secured to the insulator by the engagement of ribs into matching grooves in the insulator.

19 Claims, 6 Drawing Sheets

STRIP LIGHTING ASSEMBLY

BACKGROUND OF THE INVENTION

This invention applies to lighting systems having a plurality of spaced low-voltage light bulbs, and which are generally called tube lights or strip lights. These lights have been in use for decorative purposes, and for the functional purposes of illuminating aisles and stair treads. Such strip light systems are normally quite small, being from ¼ inch to ½ inch wide in cross section.

One type of strip light is provided with a pair of co-planar electrical conductors in an elongated insulator strip, wherein a number of lamp sockets with fixed spacing along the conductors, and the lamps are then plugged into the sockets as shown in U.S. Pat. No. 4,654,765. This requires each lamp to be fitted with an individual socket which adds the unreliability of an extra series connection to evry bulb, and also adds to the material and labor content of the system. This type strip light is also limited to only a few (normally two) conductors, within the small strip width. Another limitation of this patent is that a solder connection must be made for each conductor at each end of lighting strips that are used in tandem and connected in series by jumper wires.

Another example of a present art strip light is shown in U.S. Pat. No. 4,761,720, which overcomes the cost and reliability problems of sockets for the bulbs by soldering the bulb leads directly to the conductors This makes the bulbs (or L.E.D.'s in this example) non-replaceable, so they are sealed into the insulator strip.

Another type of strip light includes sequenced bulb illumination to provide apparent moition, which are commonly called "chase" light systems. These systems normally have four power conductors that are sequenced and connected through the bulbs to a common neutral conductor. Presently known chase light systems employ insulated wire conductors that are stripped of insulation at fixed spacings for each bulb connection, which is a permanent crimp or solder connection. Hence, presently known chase light systems do not have replaceable bulbs.

All presently known continuously illuminated or chase lighting strip systems also require the attachment (usually by soldering) of jumper wire connector plugs to electrically join the abutting ends of segments in a long run of series connected tandem lighting strips.

A primary purpose of the present invention is to provide a strip lighting system for continuous or chase lighting in which the light bulbs are removably connected to respective conductors at any point along the strip.

It is a further purpose of the present invention to provide a strip lighting system which does not employ any series-connected sockets.

It is another purpose of the present invention to provide a strip lighting system which does not employ any jumper-wire sockets between tandem strip segments.

SUMMARY OF THE INVENTION

The achievement of the foregoing purposes are achieved by including an elongated flexible insulator strip having a base including two sides and a top surface having elongated slits that retain flat electrical conductors. Miniature wire terminal lamp bulbs are adjacent to the top surface of the insulator strip with terminals extending from the top surface of the insulator strip into a slit in the insulator strip to electrically contact one side surface of a respective flat conductor at any point along the length of the insulator strip, whereby the application of electrical power from an external source to each of the respective conductors will light the bulbs. A generally U-shaped lens covers the light bulbs and has legs engaging the external source to each of the respective conductors will light the bulbs. A generally U-shaped lens covers the light bulbs and has legs engaging the sides of the insulator and inwardly-biased and secured to the insulator by the engagement of ribs into matching grooves in the insulator, whereby the lens may be locally separated from the insulator strip to remove and replace a lamp bulb.

A preferred embodiment provides the base and sides of the insulator strip in a continuous arcuate shape, and a U-shaped lens having a similar arcuate shape, whereby the assembled insulator strip and lens form a lighting strip assembly having a generally cylindrical exterior.

Another preferred embodiment provides the base and sides of the insulator strip in a right-angle relationship, and a U-shaped lens having a similar right-angle corner shape, whereby the assembled insulator strip and lens from a lighting strip assembly having a generally square exterior.

Yet another preferred embodiment provides the insulator strip in a right-angle relationship with an outward-projecting rib at each right angle apex, and a U-shaped lens having a similar right-angle shape, whereby the assembled insulator strip and lens form a lighting strip assembly having a generally square exterior with opposing ribs across the base that may engage into grooves in a mounting channel.

Yet another preferred embodiment provides for tandem series connection of lighting strip segments that are conncted with thin, flat blades mechanically and electrically joining respective flat conductors of the abutting strip light segments.

DETAILED DESCRIPTION OF THE DRAWINGS

Figure 1:
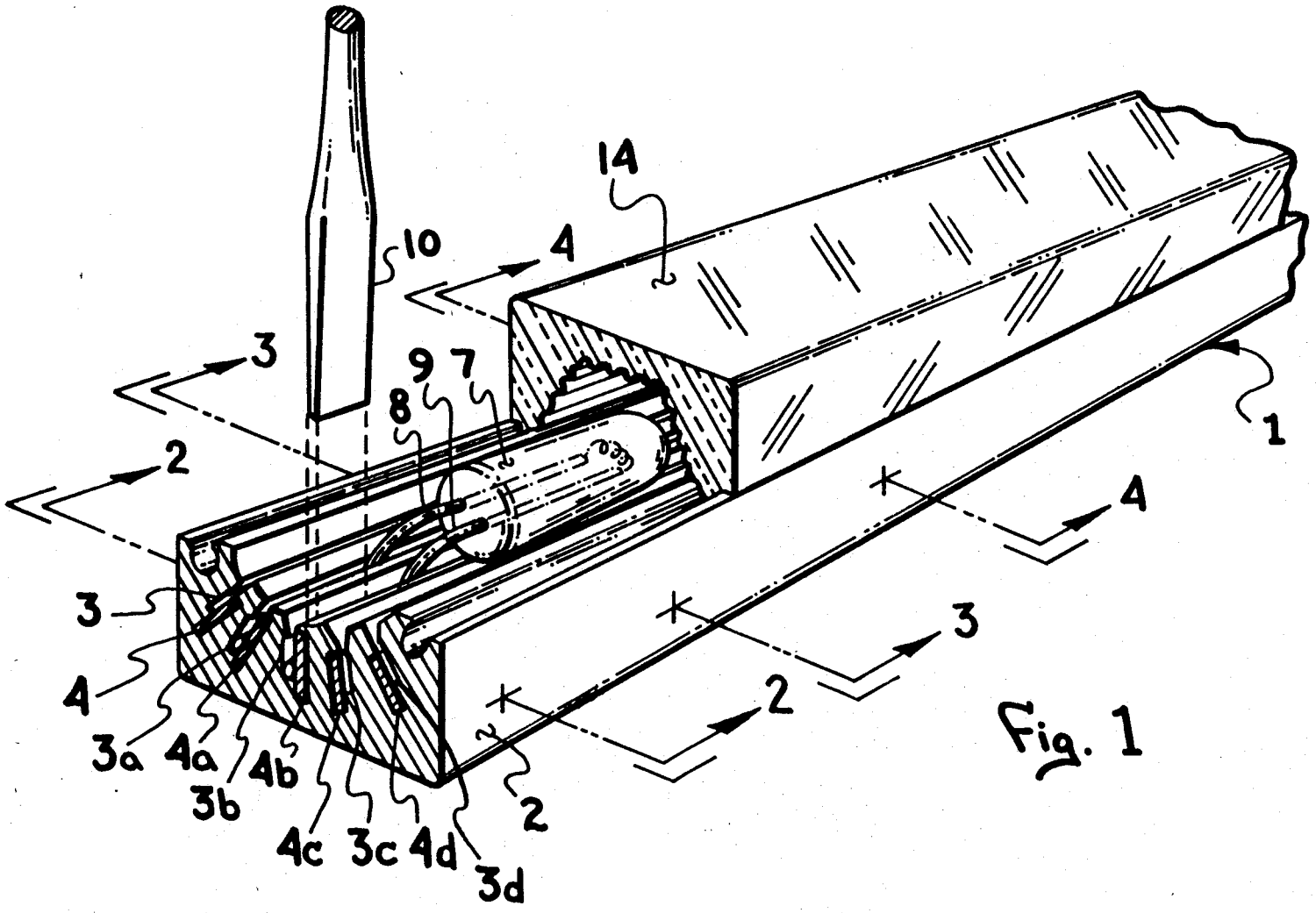
FIG. 1 shows a perspective view of a preferred embodiment of a strip lighting assembly according to the present invention.

In FIG. 1 a perspective view of a preferred embodiment of a strip lighting assembly 1 according to the present invention is shown having an elongated insulator strip 2, made of a reflective elastomer, such as flexible, white PVC including a plurality of longitudinally extending slits 3, 3*a*, 3*b*, 3*c* and 3*d*, in which flat conductors 4, 4*a*, 4*b*, 4*c* and 4*d* are respectively retained.

Figure 2:
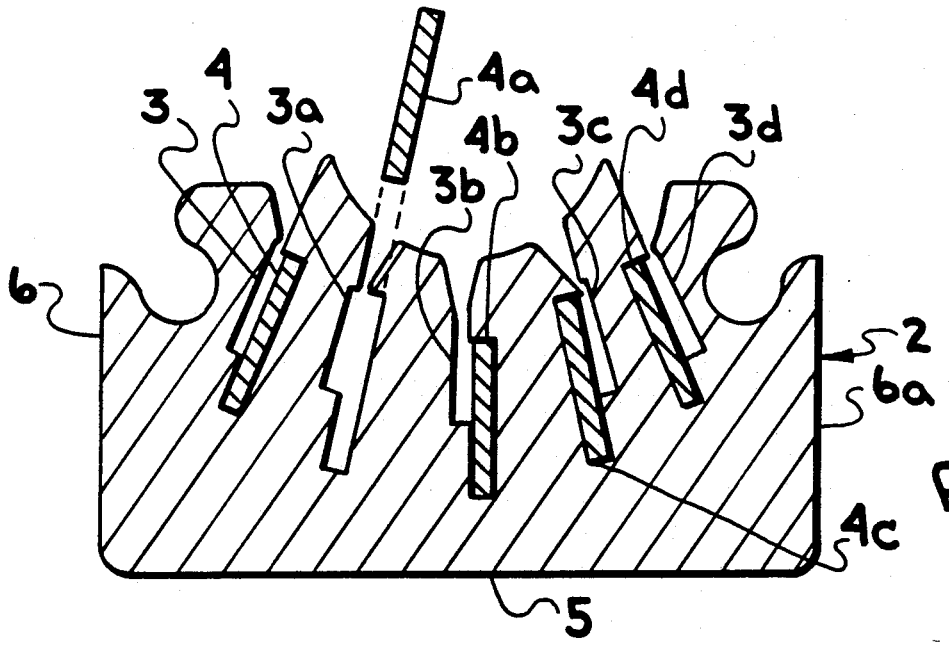
FIG. 2 is a partial cross-sectional view of the strip lighting assembly of FIG. 1, taken along section line 2—2.

In FIG. 2 a partial cross-sectional view of the strip lighting assembly of FIG. 1, taken along section line 2—2, is shown having insulator strip 2 including a plurality of longitudinally extending slits 3, 3*a*, 3*b*, 3*c* and 3*d*, in which flat conductors 4, 4*b*, 4*c* and 4*d* are respectively retained, with conductor 4*a* being inserted into slit 3*a*. Insulator strip 2 has a generally flat base 5 extending between generally vertical sides 6 and 6*a*.

Figure 3:
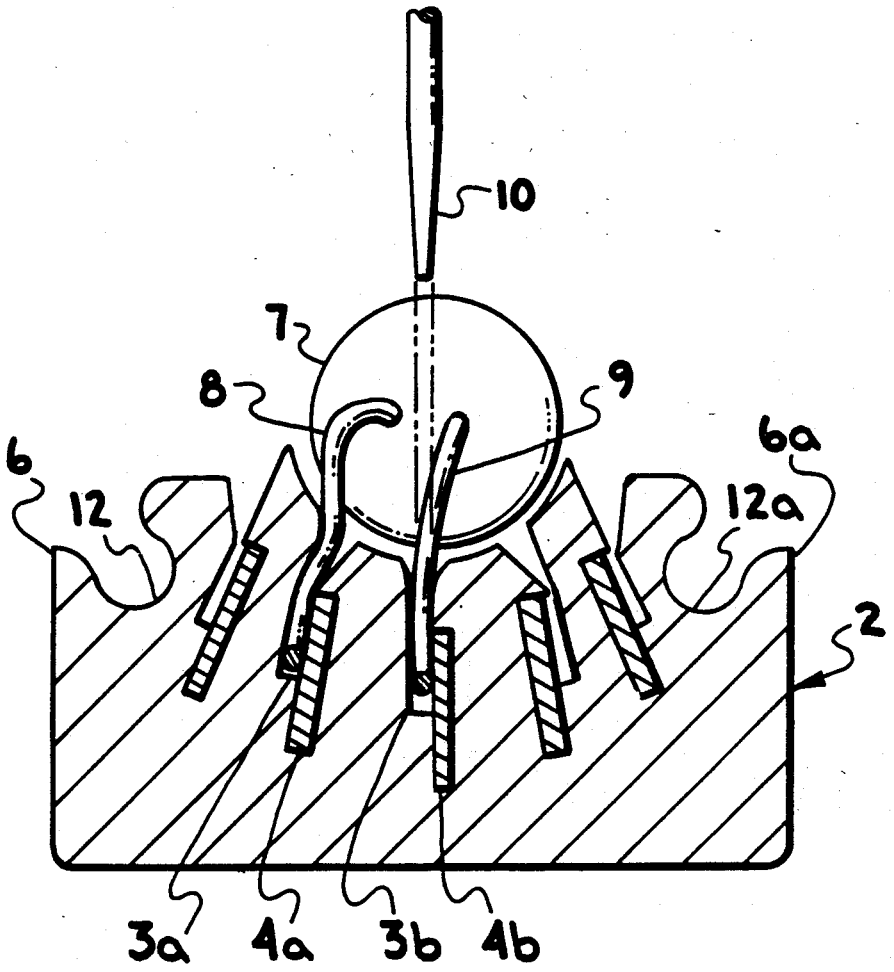
FIG. 3 is a cross-sectional view of the strip lighting assembly of FIG. 1, taken along section line 3—3.

In FIG. 3 a cross-sectional view of the strip lighting assembly of FIG. 1, taken along section line 3—3, is shown having insulator strip 2 including a plurality of longitudinally extending slits 3, 3*a*, 3*b*, 3*c* and 3*d*, in which flat conductors 4, 4*a*, 4*b*, 4*c* and 4*d* are retained. A wire terminal lamp bulb 7 is shown having a first wire terminal 8 inserted into slit 3*a* and into electrical contact with conductor 4*a*, and a second wire terminal 9 inserted into slit 3*b* and into electrical contact with conductor 4*b*, having been installed with an insertion tool 10 in the form of a thin, flat blade, such as a small screwdriver. Insulator strip 2 is provided with a first longitudinal groove 12 in side 6, and a second longitudinal groove 12*a* in side 6*a*.

Figure 4:
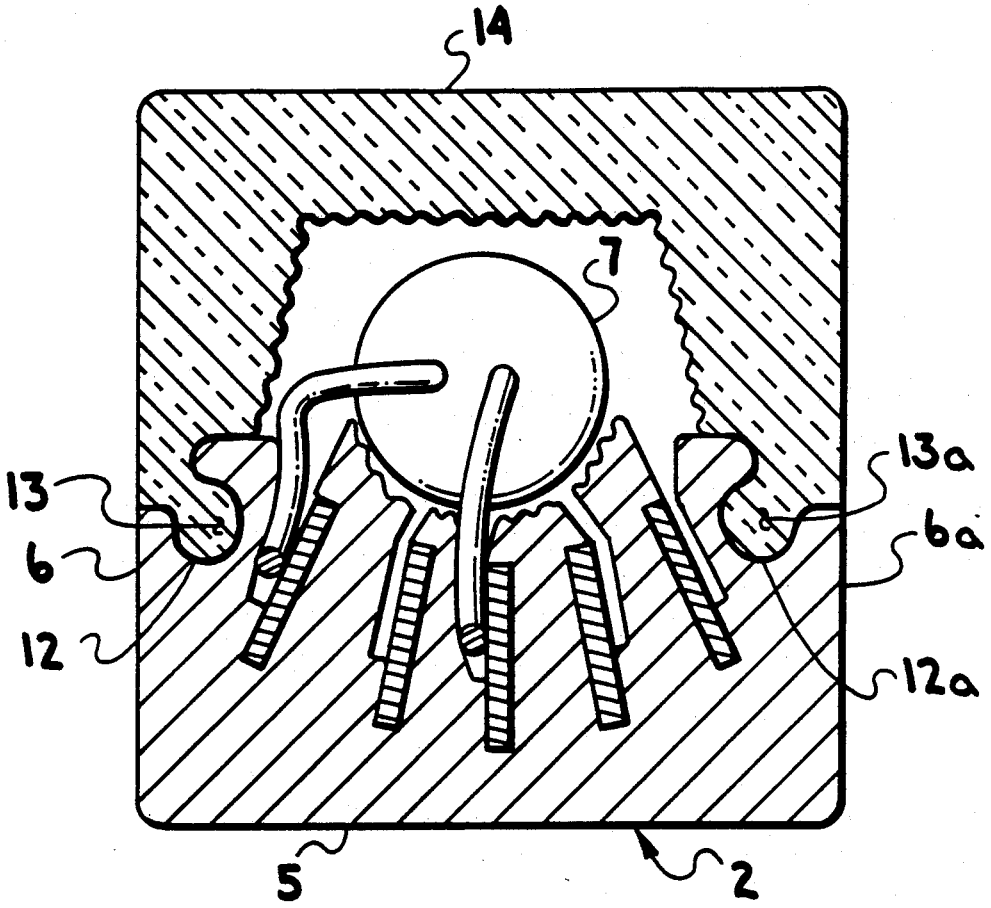
FIG. 4 is a cross-sectional view of the strip lighting assembly of FIG. 1, taken along section line 4—4.

In FIG. 4 a cross-sectional view of the strip lighting assembly of FIG. 1, taken along section line 4—4, is shown having insulator strip 2 including first longitudinal groove 12 retaining a first rib 13 and a second longitudinal groove 12*a* retaining a second rib 13*a* of a generally U-shaped lens 14 which encloses lamp bulb 7 and biases sides 6 and 6*a* inwardly.

The configuration of the strip lighting assembly as shown in FIG. 4 is suitable for several functions that are optimized by the selection of the materiels. If the strip lightIng assembly is to be used as a surface mounted lighting system the material for the insulator strip 2 would be a reflective, white, flexible PVC; and the lens would optimally be made of a rigid transparent material, such as clear polycarbonate. Conversely, if the strip lighting assembly is to be used as a suspended tube light, both the insulator strip and the lens would be made of flexible, clear PVC.

Figure 5:
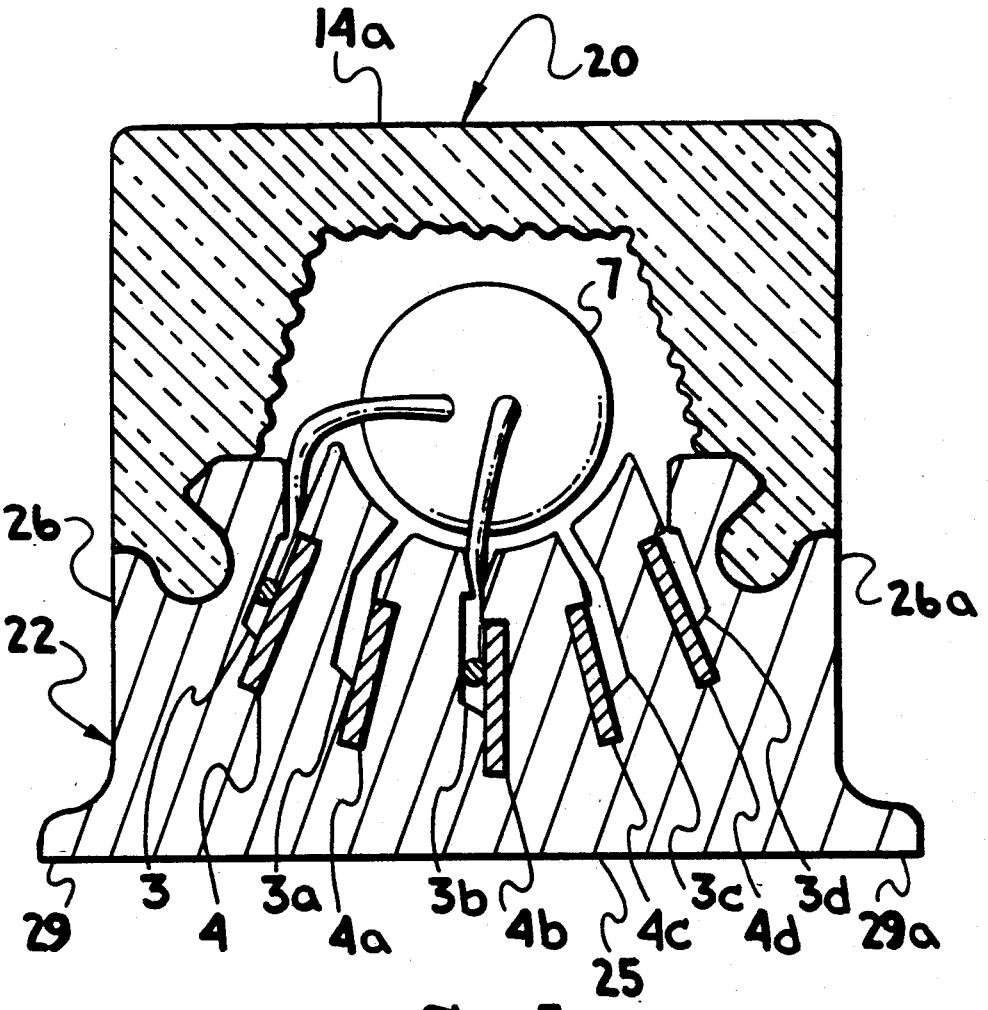
FIG. 5 is a cross-sectional view of a second preferred embodiment of a strip lighting assembly according to the present invention; ;p

In FIG. 5 cross-sectional view of a second preferred embodiment of a strip lighting assembly 20 according to the invention is shown being structurally identical to FIG. 4, except for the addition of a first base rib 29 at the lower corner of first side 26, and a second base rib 29*a* at the lower corner of the second side 26*a*.

Figure 6:
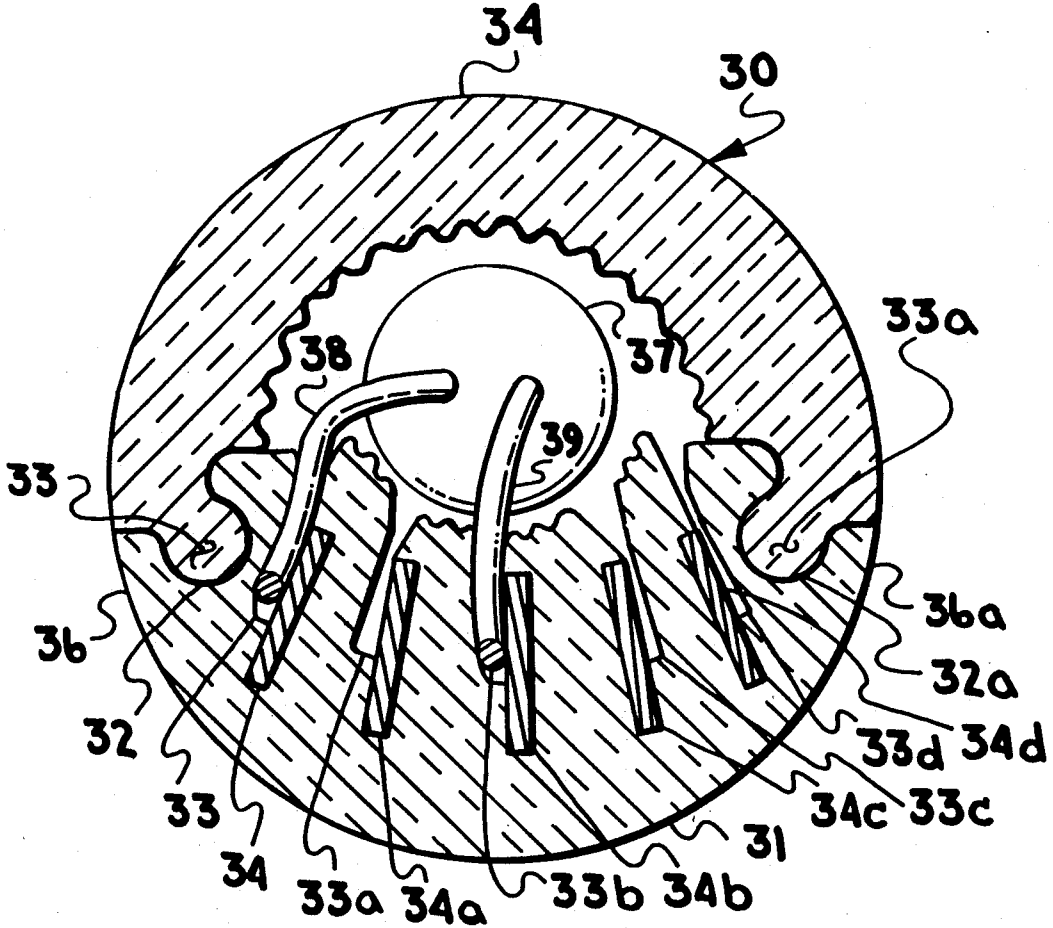
FIG. 6 is a cross-sectional view of a third preferred embodiment of a strip lighting assembly according to the present invention.

In FIG. 6 a cross-sectional view of a third preferred embodiment of a strip lighting assembly 30 according to the present invention is shown having insulator strip 31 made of a transparent elstomer, such as clear, flexible PVC, including a longitudinal slits 33, 33*a*, 33*b*, 33*c* and 33*d* retaining flat conductors 34, 34*a*, 34*b*, 34*c* and 34*d*, respectively. A lamp bulb 37 is shown having a first wire terminal 38 in contact with conductor 34 in slit 33, and a second wire contact 38 in contact with conductor 34*b* in slit 33*b*. Insulator strip 31 includes a first longitudinal groove 32 retaining a first rib 33 and a second longitudinal groove 32*a* retaining a second rib 33*a* of a generally U-shaped lens 34, made also of a transparent elastomer, such as clear, flexible PVC, which encloses lamp bulb 37 and biases sides 36 and 36*a* inwardly. Insulator 31 is generally arcuate from sides 36 to 36*a*, and U-shaped lens 34 is also generally arcuate having the same radius a insulator strip 31, whereby when ribs 33 and 33*a* are engaged into grooves 32 and 32*a*, respectively, the resulting strip lighting assembly is generally cylindrical in shape.

Figure 7:
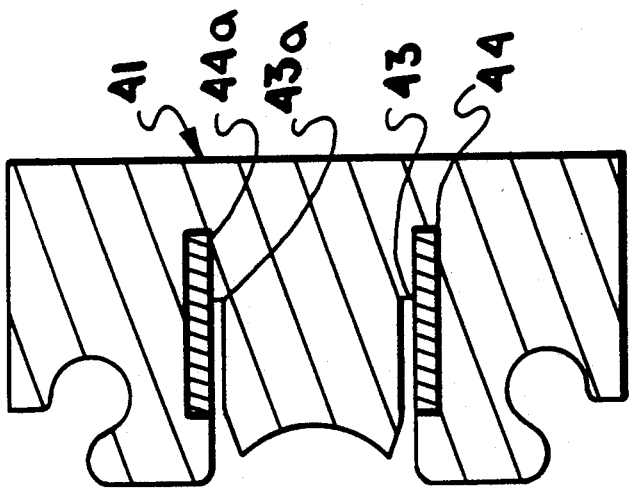
In FIG. 7 a cross-sectional view of a fourth preferred embodiment of a single-circuit strip lighting assembly according to the present invention.

In FIG. 7 a cross-sectional view of a fourth preferred embodiment of an insulator strip 41 for a strip lighting assembly according to the present invention is shown 41 made of an elastomer, such as flexible PVC, including a longitudinal slits 43 and 43*a* retaining flat conductors 44 and 44*a*. This configuration may be adapted to any of the preferred embodiments shown in FIG. 1 through FIG. 6 to make single-circuit lighting strip assemblies.

Figure 8:
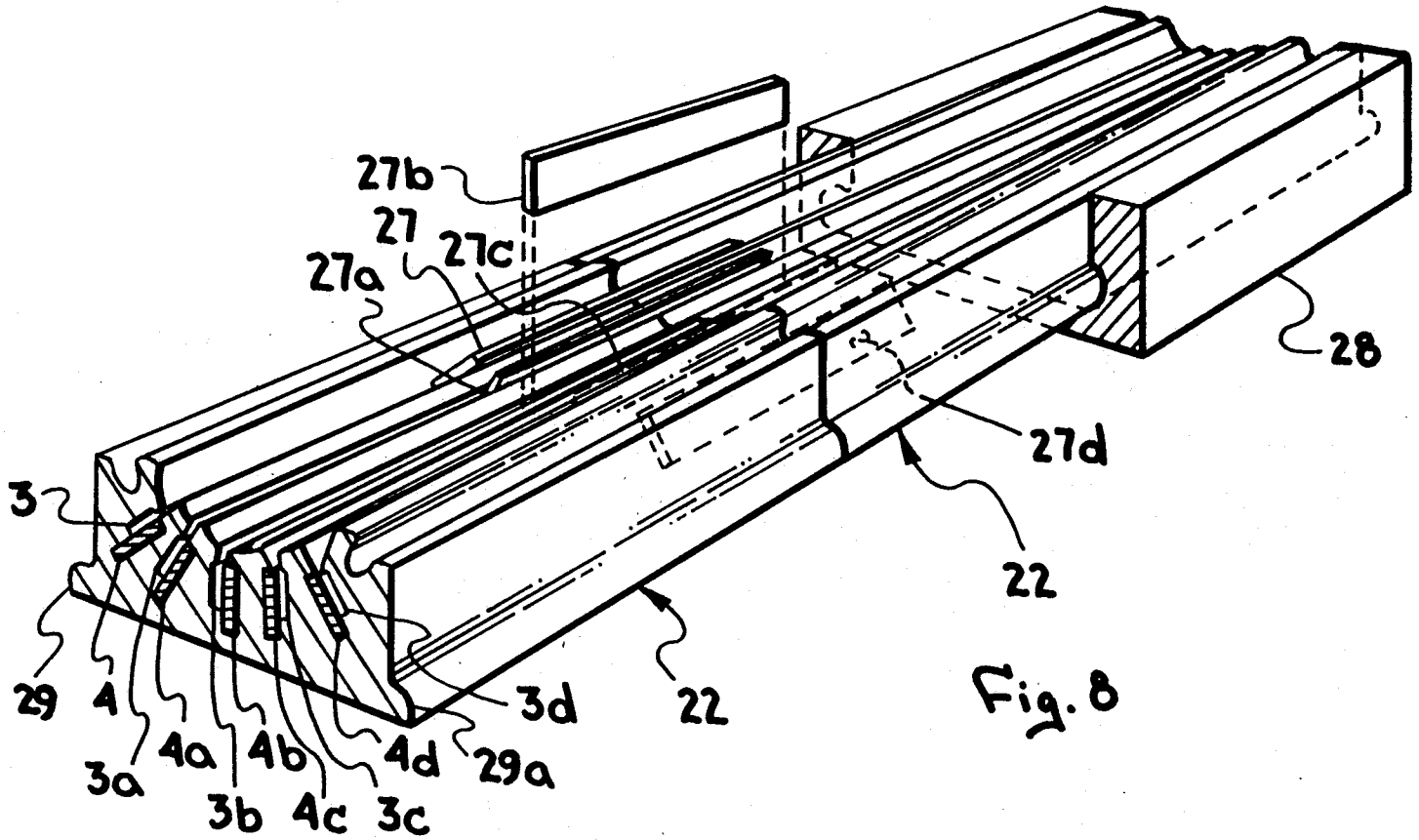
FIG. 8 is a perspective view of an embodiment of a strip lighting assembly according to the present invention in which tandem lighting strip segments are connected in straight abutting series.

In FIG. 8 a strip lighting assembly according to the present invention is comprised of a plurality of tandem lighting strip segments 22 of FIG. 5 connected in a straight abutting series connection by a thin connector blade 27, 27*a*, 27*b*, 27*c* and 27*d* inserted into each slit 4, 4*a*, 4*b*, 4*c* and 4*d* retaining a respective flat conductor 3, 3*a*, 3*b*, 3*c* and 3*d*. In addition ribs 27 and 27*a* are shown engaged into mating grooves of a rigid mounting channel 28, which may be made of a rigid plastic or metal, and may be included within such functional extrusions as stair tread caps and carpet edge moldings.

Figure 9:
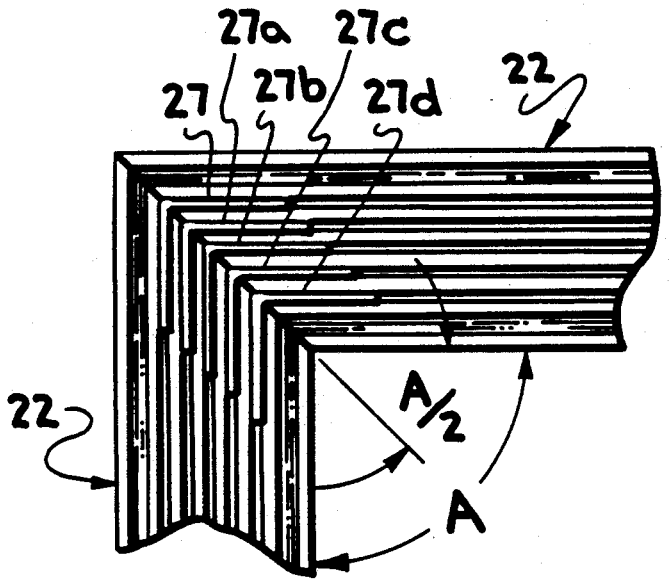
FIG. 9 is a plan view of an embodiment of a strip lighting assembly according to the present invention in which tandem lighting strip segments are connected in series at a mitered joint.

FIG. 9 is a plan view of an embodiment of a strip lighting assembly of FIG. 8 in which tandem lighting strip segments 22 and are connected in series at a mitered joint having an included angle A by cutting each segment at and angle A/2 and bending the respective thin connector blades, 27, 27*a*, 27*b*, 27*c* and 27*d* also at angle A.

In operation the conceptual simplicity of the present invention achieves the stated purposes of the invention and represents a significant improvement in cost, simplicity, appearance and reliability of low-voltage strip lighting systems.

What is claimed:

1. A low voltage strip lighting assembly including:

an elongated flexible insulator strip having a base including two sides and a top surface;

a plurality of elongated slits in said insulator strip and generally normal to the top surface;

a plurality of flat electrical conductors disposed within the slits in the insulator strip;

a plurality of miniature wire terminal lamp bulbs, each having a first wire terminal and a second wire terminal, said light bulbs being disposed adjacent to the top surface of the insulator strip and each terminal of each light bulb extending from the top surface of the insulator strip into a slit in the insulator strip to electrically contact one side surface of a respective flat conductor at any point along the length of the insulator strip, whereby the application of electrical power from an external source to each of the respective conductors will light the bulbs;

a generally U-shaped lens covering the light bulbs and having depending legs engaging the sides of the base of the elongated insulator strip.

2. A low voltage strip lighting assembly according to claim 1 in which the first electrical conductor is the neutral leg of an electrical circuit in which other conductors are power legs of the same circuit.

3. A low voltage strip lighting assembly according to claim 1 in which the first electrical conductor is the neutral leg of an electrical circuit in which other conductors are power legs of the same circuit and the power legs are time sequenced to produce an apparent light motion.

4. A low voltage strip lighting assembly according to claim 1 in which each of the depending legs of the lens is provided with an inward-projecting rib that engages a groove in either side surface of the insulator strip.

5. A low voltage strip lighting assembly according to claim 1 in which each of the depending legs of the lens is provided with an inward-projecting rib that engages a groove in either side surface of the insulator strip, and the depending legs are inwardly biased and apply a compressive force to the side surfaces of the elongated insulator strip.

6. A low voltage strip lighting assembly according to claim 1 in which the two sides of the base surface of the insulator strip are connected by a generally flat surface.

7. A low voltage strip lighting assembly according to claim 1 in which the two sides of the base surface of the insulator strip are connected by a generally flat surface, and each side of the elongated insulator strip base has an outward-projecting rib that is engageable with a groove in an external mounting channel for the lighting strip assembly.

8. A low voltage strip lighting assembly according to claim 1 in which the two sides of the base surface of the insulator strip are connected by a generally flat surface and the lens U-shape has right-angle corners, whereby the exterior of the strip lighting assembly is generally square.

9. A low voltage strip lighting assembly according to claim 1 in which the two sides of the base surface of the insulator strip are joined in a continuous arcuate surface and the generally U-shaped lens has an arcuate shape having approximately the same radius as the arcuate surface of the base and sides, and each of the depending legs of the lens is provided with an inward-projecting partial cylindrical rib that engages past its centerline into a mating groove in either side surface of the insulator strip, whereby the exterior of the strip lighting assembly is generally cylindrical.

10. A low voltage strip lighting assembly according to claim 1 in which each of the slits in the top surface of the insulator strip is provided with a tapered elongated entrance generally normal to the top surface to facilitate the entry of the bulb terminal into the slit.

11. A low-voltage strip lighting assembly according to claim 1 in which the top surface of the insulator strip is in part arcuate and generally matches the radius of the lamp bulb and locates the bulb therein.

12. A low-voltage strip lighting assembly according to claim 1 in which the insulator strip is optically transparent.

13. A low voltage strip lighting assembly according to claim 1 in which the insulator strip is optically reflective.

14. A low voltage strip lighting assembly according to claim 1 in which the elongated insulator strip is made of an elastomeric material.

15. A low voltage strip lighting assembly according to claim 1 in which the elongated insulator strip and the lens are both made of an elastomeric material.

16. A low voltage strip lighting assembly according to claim 1 in which the elongated insulator strip is made of an elastomeric material and the lens is made of an inelastic material.

17. A low voltage strip lighting assembly according to claim 1 in which the depending legs of the lens are inwardly biased and apply a compressive force normal to sides of the flexible insulator strip.

18. A low voltage strip lighting assembly according to claim 1 in which a plurality of tandem lighting strips have their respective flat conductors connected in series by insertion of a flat blade conductor into each abutting slit of the respective adjacent tandem lighting strips.

19. A low voltage strip lighting assembly according to claim 1 in which a plurality of tandem lighting strips have their respective flat conductors connected in series by a flat blade conductor bent about the apex of an angle and inserted into each abutting conductor slit of the respective adjacent tandem lighting strips which are miter cut to abutt at the same angle.

* * * * *